United States Patent [19]

Swaniger

[11] 4,007,681

[45] Feb. 15, 1977

[54] TAPE GUIDE FOR POSTAGE METER PRINTING MACHINE

[75] Inventor: James R. Swaniger, Bridgeport, Conn.

[73] Assignee: Pitney-Bowes, Inc., Stamford, Conn.

[22] Filed: May 16, 1975

[21] Appl. No.: 578,328

[52] U.S. Cl. ..... 101/288; 156/541

[51] Int. Cl.[2] ..... B41F 1/08

[58] Field of Search ..... 101/234, 92, 232, 292, 101/288; 156/540, 541, 545, 584

[56] References Cited

UNITED STATES PATENTS

| | | | |
|---|---|---|---|
| 2,576,710 | 11/1951 | Andrews | 156/584 X |
| 3,169,895 | 2/1965 | Sohn | 156/541 |
| 3,583,889 | 6/1971 | Califano et al. | 156/540 |
| 3,791,293 | 2/1974 | Rastorquyeff et al. | 101/234 |

*Primary Examiner*—Edgar S. Burr
*Assistant Examiner*—R. E. Suter
*Attorney, Agent, or Firm*—Robert E. Meyer; William D. Soltow, Jr.; Albert W. Scribner

[57] ABSTRACT

A tape guide for deflecting a print-receiving portion of a tape upwardly at the exit of a printing machine of the postage meter type so it can be grasped and torn by the machine operator. The guide consists of interstaggered rollers which have conical cross-sections to present a knife edge or line contact only to the adhesive backing on the tape to preclude adhesive from building up a substantial deposit on the guiding surface. The rollers may increase in diameter in the path of travel of the tape so it is deflected upwardly.

2 Claims, 5 Drawing Figures

FIG. 4
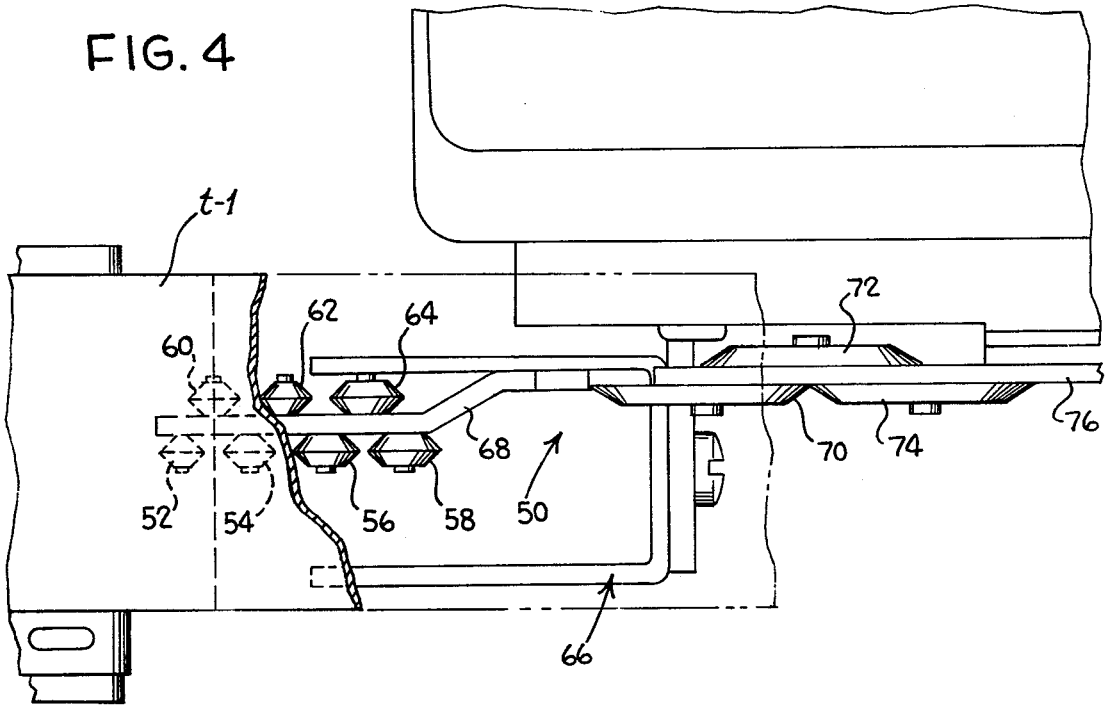
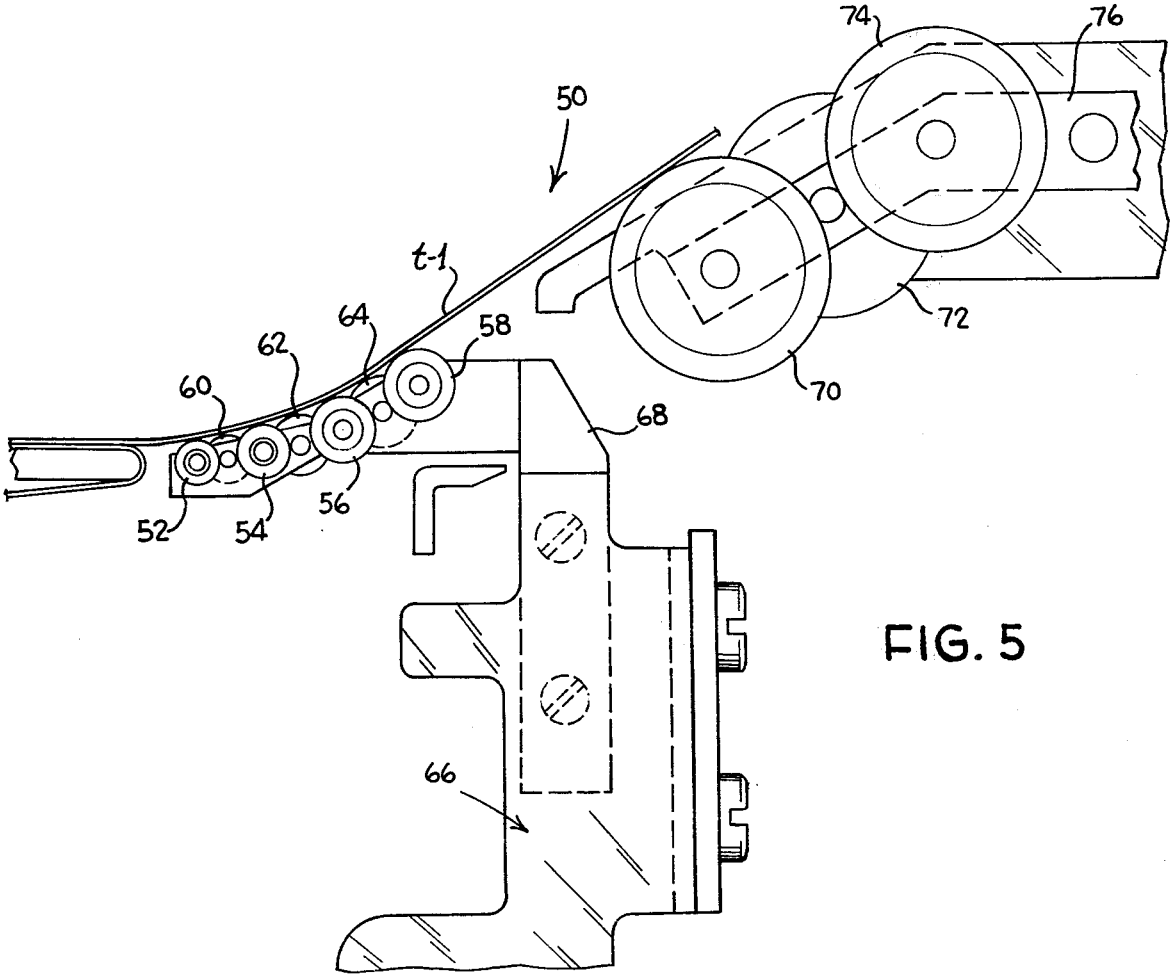
FIG. 5

TAPE GUIDE FOR POSTAGE METER PRINTING MACHINE

BACKGROUND OF THE INVENTION

1. Field of the Invention

This invention relates to a tape guide, and more particularly, to a tape guide in a postage meter type printing machine.

2. Description of the Prior Art

U.S. Pat. No. 3,791,293, assigned to the assignee of the instant invention, discloses a flat-bed printing machine of the postage meter type which can print postage or postage and advertising indicia selectively on letters or on a tape, which in the case of the latter, can be adhered either to an envelope or a parcel. A composite tape is used when the machine is in its tape mode.

This tape comprises a print receiving first strip which has a backing of pressure sensitive adhesive. This strip is divided into units of equal length by perforations defining lines of tear across the tape. A protective second strip is adapted to overlie the adhesive backing of the first strip. The protective second strip extends laterally beyond the first strip along one edge. The extended edge portion of the second strip is slotted with slots or perforations, the midpoints of which, are spaced apart the same distance as the lines of tear in the first strip and are aligned with the lines of tear in the first strip.

The composite tape is threaded through the postage meter printing machine so that an impression can be formed during each print operation on either one or two units of equal length of the first strip of the tape, each unit being defined by the lines of tear across the tape. As the tape is threaded through the postage meter type printing apparatus the tape is advanced from a source of supply such as a tape roll mounted on a first reel, over guide means, a vertically reciprocable track, and at the outer end of the track the protective second strip is separated from the first strip and is led back where its free end is engaged with a second reel which is power-driven to wind up the second strip and thereby advance both strips. The slots or perforations on the extended edge portion of the second strip are placed into meshing engagement with radial projections on a star wheel to rotate the star wheel through a predetermined arc as the tape is advanced. Pins, selectively extended from the rear of the star wheel are used to deactuate the motor driving the take-up reel after either one or two units of the free end of the print-receiving portion of the tape are projected from the machine, with printed indicia thereon.

After each print operation, the free end of the print-receiving strip is projected from one end of the machine and torn off at a line of tear which is disposed adjacent to the point of separation between the two tape strips and also adjacent to the end of the machine. A ramp or inclined tape guide is positioned to contact the free end of the print-receiving strip as it is projected from the machine to deflect it upwardly so it can be readily grasped by the machine operator and torn.

The inclined tape guide includes a pair of spaced, inclined bars which contact the tape along spaced planes.

With the tape threaded through the tape handling apparatus as described above and a postage meter properly assembled with it, a label printing and advancing operation is initiated by the operator depressing a key of the postage meter thus actuating its platen to elevate the tape track bringing the tape which is on the track into contact with a printing head which is within the postage meter.

In falling back to its lower position, the tape supporting track causes actuation of a switch which turns on a motor. The rotation of the motor shaft turns the reel on which the protective second strip is wound up, also unwinding the composite tape from the tape supply reel and advancing it a predetermined distance through the guide means and over the track. The star wheel is rotated by the advancing tape which through its contact pins will deactuate the motor after the print-receiving portion of the tape has advanced either one or two units and is projected and deflected upwardly from the machine.

The inclined tape guide for deflecting the tape includes a pair of spaced, inclined bars, each of which contacts the tape along its adhesive backing layer along spaced planes as it is projected from the machine. It was found that the adhesive backing layer would rub off onto the inclined bars after repeated use of the machine. Subsequent deflection of the imprinted tape units soon became impossible since their adhesive backing would stick to the bars, causing the tape to jam at its exit point from the machine.

In order to alleviate this problem, the print-receiving portion of tape was fabricated so that the adhesive backing layer was not present on the tape along its planes of contact with the inclined deflecting bars. While this solved the jamming problem, it created new problems in the fabrication of the tape since the adhesive backing layer had to be removed or omitted along two parallel planes precisely aligned with the planar surfaces of the deflecting bars which would come into contact with the tape. Accordingly, this solution to the jamming problem was ineffectual.

SUMMARY OF THE INVENTION

The present invention relates to a new tape guide for use in a postage meter printing machine of the type disclosed in U.S. Pat. No. 3,791,293. The necessity of providing a specially fabricated tape having an adhesive backing layer omitted along two parallel planes to overcome by providing an inclined tape guide for deflecting the tape as it is projected from the machine which only has line contact with the adhesive backing layer of the print-receiving portion of the tape.

This is accomplished by providing a series of increasing diameter rollers in the projected path of the free end of the print-receiving portion of the tape which has line contact only with the adhesive backing layer on the tape. This precludes excessive amounts of adhesive from accumulating on the contact surfaces of the tape guide, thereby permitting the adhesive layer on the tape to be disposed throughout its width, relieving the fabrication problem.

The rollers are generally conical in cross-section presenting a knife edge or line contact with the backing layer of the tape and more than one row may be provided if desired. They increase in diameter to provide an inclined contact surface with the tape to deflect the tape upwardly so it can be readily grasped and torn by the machine operator.

Further objects and advantages of the present invention will become more apparent from the following specification and claims and from the accompanying drawings, wherein:

BRIEF DESCRIPTION OF THE DRAWINGS

FIG. 4 is an enlarged top plan view of the right hand end of the machine illustrated in FIG. 1 showing the tape guide of the present invention; and FIG. 5 is a front view in elevation of the tape guide portion of the machine shown in FIG. 4.

DETAILED DESCRIPTION OF THE PREFERRED EMBODIMENT

Figures 1, 2, 3:
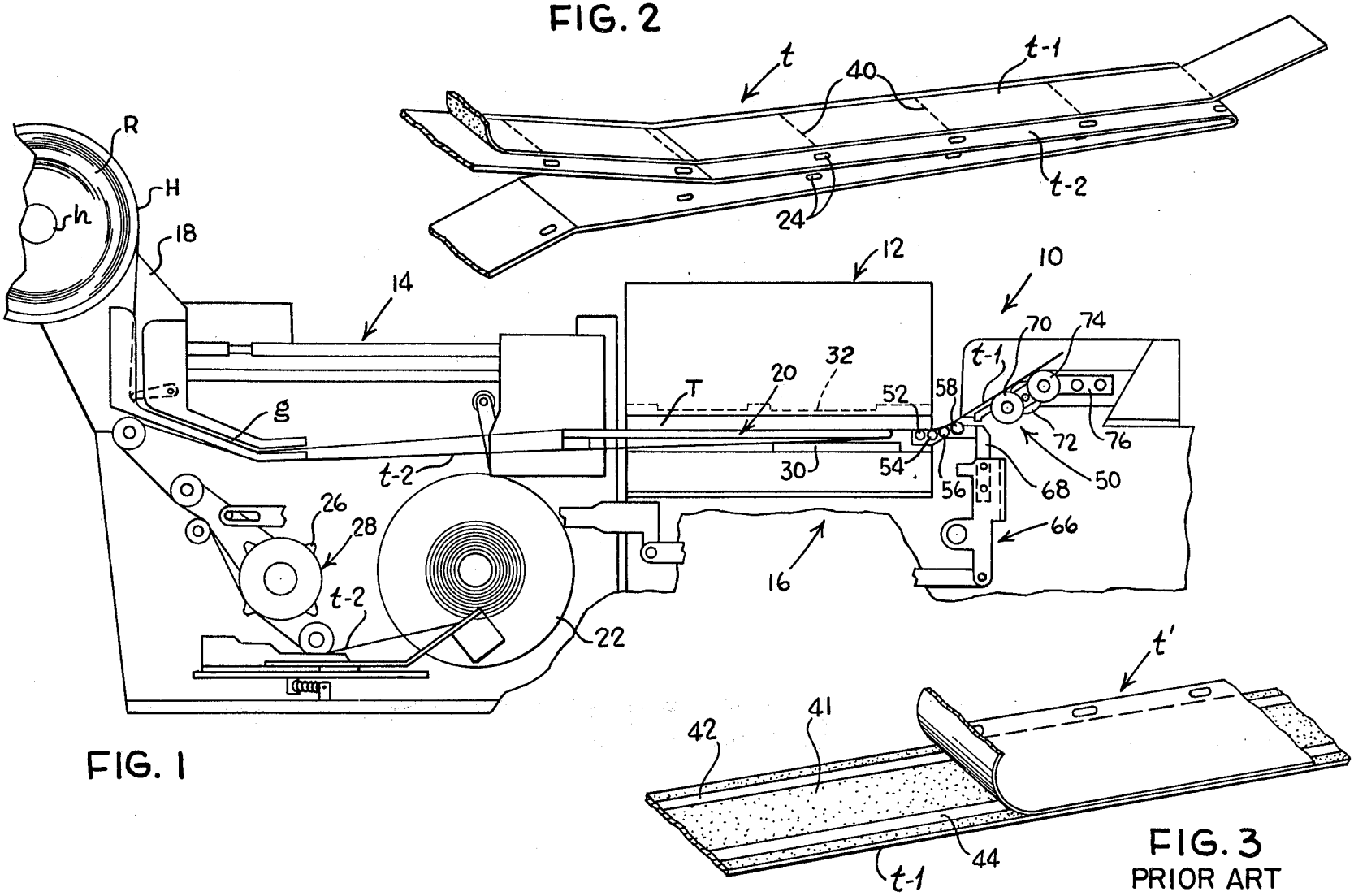
FIG. 3 PRIOR ART
FIG. 1 is a partial front elevation of a flat-bed printing machine of the postage meter type, with the front cover of the machine removed and with parts omitted, partly cut away, and with others in cross-section for purposes of clarity in illustrating the present invention.
FIG. 2 is a perspective view showing a length of the composite tape used in the machine and disposed as it is on the tape track.
FIG. 3 is a perspective view showing a length of a composite tape previously used in the machine.

Referring now to the drawings in detail, wherein like numerals indicate like elements throughout the several views, a machine generally indicated by the numeral 10 is illustrated in FIG. 1, which is a flat-bed printing machine of the postage meter type which can print indicia, such as postage, selectively on letters or on a tape. The operation and details of construction of this machine are described and illustrated in U.S. Pat. No. 3,791,293, assigned to the same assignee of the instant invention. Except for purposes of background information, further reference to details of this machine will only be made to that portion constituting the improvement in the machine which is the subject matter of this invention.

The machine 10 generally comprises three sections, indicated by the numerals 12, 14 and 16, respectively. Section 12 is a postage meter of known kind for printing a postage stamp impression with or without other indicia in the upper right hand corner of a letter or a tape, the latter being adapted to be adhesively applied to a letter or parcel. Section 14 contains a tape handling means including a tape carrier projectible into the throat T of the postage meter section 12. Section 16 laterally adjoins section 14 and provides a base on which postage meter section 12 is placed. It contains a drive means for actuating a letter eject mechanism when the machine is in letter operating mode, and for driving a tape strip pick-up roll when the machine is in its tape operating mode. It also contains means connected with means at section 14 and responsive to the position of the tape carrier for shifting the drive means between letter and tape operating modes.

Tape t from a supply roll R mounted on the hub *h* of a tape supply roll holder H rotatively mounted on an arm 18 extending up from the left hand end of section 14 is led through a slot in the holder H and under the tensioning end of a clamp (not shown) through a guideway *g* to a tape carrier 20 which *g.* spaced from the forward end of the guideway *g.*

The tape t used in the machine is a composite tape of the kind described in detail in both U.S. Pat. Nos. 3,791,293 and 3,712,527. The tape t is illustrated in FIG. 2 and is provided with a print-receiving top ply tape strip *t*-1, which is separated from an under ply protective strip *t*-2 adjacent the forward end of tape carrier 20. The protective strip *t*-2 extends all the way from the tape supply roll R to a take-up reel 22 and not only carries strip *t*-1 with it to the point of separation but also has slots 24 in its margin which engage peripheral radial projections 26 on a star wheel generally indicated by numeral 28. Tape strip *t*-2 causes the star wheel 28 to rotate through meshing engagement of slot 24 with peripheral radial projections 26 as the tape strip *t*-2 is advanced and wound up on the pick-up reel 22.

As described in the aforementioned U.S. Pat. No. 3,791,293, a platen 30 is raised each time a starting switch control button is depressed and lifts any workpiece positioned within the throat T into contact with a flat-bed printing means 32, disposed above the throat T. In this manner indicia can be printed upon tape ply *t*-1. The manner of lifting tape guide 20 by the platen 30 during the printing operation is described in U.S. Pat. No. 3,791,293 and does not comprise any portion of the present invention.

The star wheel 28 has about its periphery radial projections 26 adapted to engage slots 24 provided along one margin of the tape strip *t*-2 and has projecting from its rear face a preselected number of pins, (not shown), the spacing between said pins determining the extent of each tape advance. Star wheel 28 and its manually positionable pins are described in U.S. Pat. No. 3,712,527 and are shown in U.S. Pat. No. 3,791,293 and since per se they do not constitute a part of the instant invention they are not described herein except to point out that when the tape strip *t*-2 is advanced star wheel 28 is rotated due to the engagement of the projections 26 in tape holes 24; and the number of pins projecting from the rear face of the star wheel may be controlled, as shown in said U.S. Pat. No. 3,712,527. When four pins are projected the distance between successive projected pins corresponds with a unit length of the tape strip *t*-1, which desirably is the distance between transverse perforations 40 in the tape strip *t*-1. When only two pins are projected, the distance between them corresponds with the length of two tape units. Therefore only two diametrically opposed pins are employed when it is desired to print a label equal in length to two units of tape strip *t*-1, and four pins are used when it is desired to print only one unit length of the tape.

As shown in U.S. Pat. No. 3,791,293, as star wheel 28 is rotated after each printing operation wherein the tape *t* is advanced, the projecting pins on the rear face of the star wheel 28 are adapted to strike a segmental cam which in turn deactuates a switch controlling the motor driving take-up reel 22. When the switch is deactuated, tape *t*-1 will be advanced after the printing operation a sufficient distance so as to present either one or two unit lengths of the tape *t*-1 to the operator for tearing at a perforation 40.

As shown in U.S. Pat. No. 3,791,293, the printed tape strip *t*-1 is ejected from the end of the machine so as to give the operator room to grasp the end of the tape strip and tear it off along one of the lines of perforation 40. Towards this end a bent over ramp defining a pair of pivoted ramp bars are provided to establish a pair of upwardly sloping or inclined surfaces which serve to deflect upwardly the printed leading end of projected tape strip *t*-1. It was found that the adhesive backing layer would rub off onto the inclined bars after repeated use of the machine. Subsequent deflection of the imprinted tape units soon became impossible since their adhesive backing would stick to the bars, causing the tape to jam at its exit point from the machine.

In order to alleviate this problem, the print-receiving portion *t*-1 of tape *t* was fabricated so that the adhesive backing layer 41 was removed from the tape *t'* along its plane of contact with the inclined deflecting bars, as shown at 42 and 44 in FIG. 3. While this solved the jamming problem, it created new problems in the fabrication of the tape since the adhesive backing layer 41 had to be removed or omitted along two parallel planes precisely aligned with the planar surfaces of the deflecting bars which would come into contact with the tape. Accordingly, this solution to the jamming problem was ineffectual.

The necessity of providing a specially fabricated tape *t'* having an adhesive backing layer 41 omitted along two parallel planes 42 and 44 is overcome by providing an inclined tape guide 50 for deflecting the tape *t*-1 as it is projected from the machine 10 which only has line contact with the adhesive backing layer of the print-receiving portion of the tape.

This is accomplished by initially contacting the tape portin *t*-1 with two staggered series of increasing diameter rollers 52, 54, 56, 58 and 60, 62, 64 in the projected path of the free end of the print-receiving portion *t*-1 of the tape *t* which has line contact only with the adhesive backing layer on the tape. Also the rollers roll the tape out, rather than letting it slide on any machine member. This precludes excessive amounts of adhesive from accumulating on the contact surfaces of the tape guide, thereby permitting the adhesive layer on the tape to be disposed throughout its width, relieving the fabrication problem.

The rollers 52 – 58 and 60 – 64 are beveled in cross-section presenting a pair of knife edges or line contacts with the adhesive backing layer of the tape *t*-1 and the two series are interstaggered to assure substantial contact throughout the length of the projected end of tape portion *t*-1 and to assure that the tape cannot wrap around any of the rollers or contact any fixed member in the tape path area. They increase in diameter to provide an inclined contact surface with the tape *t*-1 to deflect the tape upwardly so it can be readily grasped and torn by the machine operator at perforations 40.

The rollers 52 – 58 and 60 – 64 are mounted for rotation on a generally U-shaped in cross-section ramp bracket 66 having an arm 68 carrying the rollers into the path of the printed ply *t*-1 of tape *t*. Ramp bracket 66 is pivotably mounted in machine 10 as described in U.S. Pat. No. 3,791,293, so that it can be pivoted to a non-use position when machine 10 is in its letter printing mode.

A third set of still increased diameter, staggered rollers 70, 72 and 74, rotatably mounted on an inclined bracket arm 76 affixed to the machine, can be used as a final guide for tape portion *t*-1 as it is projected from the machine. These rollers are of the same diameter, but of a diameter greater than the diameter of rollers 52 – 58 and 60 – 64 and enable greater upward deflection of tape portion *t*-1 so that it can be easily grasped by the operator and further prevents the tape from adhering to any other machine member. Rollers 70, 72 and 74 are conical in cross-section to present a knife edge line of contact to the adhesive backing on tape portion *t*-1 and are staggered to assure contact along the entire length of tape portion *t*-1.

What is claimed is:

1. A machine for printing indicia on a tape strip of record material having a backing layer of a sticky substance comprising:

a printing station disposed within the machine, a printing means disposed within the machine in predetermined position relative to the printing station for printing indicia on said tape strip, means for supporting a length of said tape of said printing station for a printing operation, means operable in response to said printing operation at said printing station for advancing the tape strip over said support means a predetermined amount to position the printed-on portion of said tape strip to be detached from the remainder of said tape strip, and means for guiding said printed-on portion of said tape to a position for detachment from the remainder of said tape, said tape guide means including a plurality of rollers located adjacent said printing station with the axis of each roller being perpendicular to the direction of said tape advance and each of said rollers being positioned a greater distance from said printing station than the preceding roller, each of said rollers being conical in cross-section to form a knife edge on its circumference to contact the backing layer of said tape, and a portion of said plurality of rollers are of the same diameter but are connected to an inclined surface so as to deflect said tape strip upwardly along its length as the tape is placed into contact with said rollers.

2. A machine for printing indicia on a tape strip of record material having a backing layer of a sticky substance comprising:

a printing station disposed within the machine, a printing means disposed within the machine in predetermined position relative to the printing station for printing indicia on said tape strip, means for supporting a length of said tape at said printing station for a printing operation, means operable in response to said printing operation at said printing station for advancing the tape strip over said support means a predetermined amount to position the printed-on portion of said tape strip to be detached from the remainder of said tape strip, and means for guiding said printed-on portion of said tape to a position for detachment from the remainder of said tape, said tape guide means including a plurality of rollers located adjacent said printing station with the axis of each roller being perpendicular to the direction of said tape advance, each of said rollers being positioned a greater distance from said printing station than the preceding roller, each of said rollers being concial in cross-section to form a knife edge on its circumference to contact the backing layer of said tape, said rollers are alternately interstaggered with respect to the preceeding and following rollers to contact said tape strip substantially throughout the length of said tape strip.

* * * * *